US005857523A

United States Patent [19]

Edwards

[11] Patent Number: 5,857,523

[45] Date of Patent: Jan. 12, 1999

[54] WELL COMPLETION LUBRICATOR VALVE

[75] Inventor: Jeffrey Charles Edwards, Aberdeen, United Kingdom

[73] Assignee: Expro North Sea Limited, United Kingdom

[21] Appl. No.: 765,601

[22] PCT Filed: May 22, 1995

[86] PCT No.: PCT/GB95/01150

§ 371 Date: Feb. 24, 1997

§ 102(e) Date: Feb. 24, 1997

[87] PCT Pub. No.: WO96/00835

PCT Pub. Date: Jan. 11, 1996

[30] Foreign Application Priority Data

Jun. 30, 1994 [GB] United Kingdom ..... 9413142

[51] Int. Cl.[6] ..... E21B 33/068; E21B 34/10

[52] U.S. Cl. ..... 166/374; 166/70; 166/97.1; 166/321; 166/379

[58] Field of Search ..... 166/70, 72, 75.15, 166/97.1, 319, 321, 374, 379

[56] References Cited

U.S. PATENT DOCUMENTS

| | | | |
|---|---|---|---|
| 3,915,228 | 10/1975 | Giebeler | 166/321 |
| 3,967,647 | 7/1976 | Young | 166/321 |
| 4,047,564 | 9/1977 | Nix et al. | 166/72 |
| 4,100,969 | 7/1978 | Randermann, Jr. | 166/324 |
| 4,130,166 | 12/1978 | Akkerman | 166/324 |
| 4,185,690 | 1/1980 | Kinney | 166/183 |
| 4,249,599 | 2/1981 | Krause | 166/319 |
| 4,368,871 | 1/1983 | Young | 251/58 |
| 4,444,266 | 4/1984 | Pringle | 166/324 |
| 4,610,308 | 9/1986 | Meek | 166/321 |
| 4,658,904 | 4/1987 | Doremus et al. | 166/374 |
| 4,688,593 | 8/1987 | Pringle et al. | 137/116 |
| 4,694,903 | 9/1987 | Ringgenberg | 166/250 |
| 4,903,775 | 2/1990 | Manke | 166/373 |
| 5,343,955 | 9/1994 | Williams | 166/386 |

FOREIGN PATENT DOCUMENTS

93/03255 2/1993 WIPO .

*Primary Examiner*—Hoang C. Dang
*Attorney, Agent, or Firm*—Gifford, Krass, Groh, Sprinkle, Patmore, Anderson & Citkowski, P.C.

[57] ABSTRACT

Apparatus and method of isolating a well to allow intervention equipment to be installed in the upper section of tubing and surface equipment to be tested prior to running in the well is described which enables a surface test tree to be leak-off tested on a regular basis and enables the SSTT valves to be pressure tested before opening and after relatch. This is achieved by providing a completion lubricator valve comprising a fail open valve (18) located above a conventional downhole safety valve (20), the fail open valve (18) being closable by the application of hydraulic closure pressure (42) to allow a pressure differential to be supported from above. The valves (18, 20) are flapper valves and are spring-biased to open or closed positions as necessary. This allows the intervention equipment to be installed in the upper section of the tubing and the surface equipment to be tested prior to running in the well and enables the injection head to be installed immediately upon the production tree.

6 Claims, 1 Drawing Sheet

WELL COMPLETION LUBRICATOR VALVE

The present invention relates to a downhole safety valve for use in a wellbore and particularly but not exclusively for use in through tubing intervention work horizontal production completions.

The use of horizontal drilling techniques has seen a considerable increase in the use of stiff wireline to log and to intervene in horizontal wells. A major disadvantage of such horizontal drilling techniques is the long length of the intervention equipment required in the well. String lengths of over 100 ft. are commonplace and, consequently, the rigging up of pressure retaining equipment on surface is both hazardous and time consuming.

A conventional safety valve used in wells is a downhole lubricator valve and such valves are commonly used in floating vessel operations. Such a conventional safety valve is a "failsafe close" valve which, if it fails, closes the valve to isolate the well. Conventional lubricator valves cannot be utilised in connection with horizontal drilling techniques because with the very large string lengths this would involve constructing a substantial structure above the surface test tree and this is, as mentioned above, hazardous and time consuming. A further problem with existing horizontal well completions is that all-through tubing intervention work has to be performed by coil tubing and the surface rig up for this type of operation is also hazardous and time consuming. In addition, the downhole safety valve should enable the surface test tree to be leak-off tested on a regular basis and enable the SSTT valves to be pressure tested before opening and after relatch. This is not possible with existing valves.

An object of the present invention is to provide an improved apparatus and a method of isolating the well to allow intervention equipment to be installed in the upper section of tubing and surface equipment to be tested prior to running in the well which obviates or mitigates at least one of the aforementioned disadvantages of the prior art systems.

This is achieved by installing a fail open valve above a conventional downhole safety valve, the fail open valve being closable by the application of hydraulic closure pressure to allow a pressure differential to be supported from above. This allows the intervention equipment to be installed in the upper section of the tubing and the surface equipment to be tested prior to running in the well and enables the injection head to be installed immediately upon the production tree.

In a preferred arrangement the completion lubricator valve is provided by two flapper valves; the upper flapper valve known as a fail open test valve, (FOTV) is normally biased closed and if the valve fails, it fails in to the open position. The lower valve is a standard sub-sea safety valve which is a failsafe close valve and, in the event of valve failure, closes to isolate the well. The completion lubricator valve is the combination of the FOTV and SSSV.

The FOTV and SSSV have hydraulic control lines for actuating the valves with and also springs for biasing the valves into an open or a closed position.

According to a first aspect of the present invention there is provided a completion lubricator valve for use with horizontal well completions, said completion lubricator valve comprising:

an upper test valve means arranged to stay open in the event of valve failure, said upper test valve means having first means for moving said valve between an open position and a closed position, said first valve being urged into an open position in the absence of external force applied to said upper test valve means, a lower test valve means spaced from said upper test valve means and arranged to close the bore of the completion lubricator valve in the event of failure of said lower test valve means, said lower test valve means having second means for moving said valve between an open and a closed position, said second valve means being urged into a closed position in the absence of an external force applied to said lower test valve means, the arrangement being such that when an external force is applied to said upper test valve means said valve is moved to a closed position and a pressure test can be performed against said closed valve from above, and in the absence of an external force being applied to said lower tool valve means the valve is closed and a leak-off test can be performed against said lower test valve means from below.

Preferably, said upper valve means and said lower valve means are flapper valves. Alternatively, said upper and lower valve means are apertured ball valves.

Preferably also, said first and said second means for moving said respective upper and lower valves comprise a mandrel moveable in a bore of a housing and a coil spring disposed between the wall of said mandrel and said housing, said mandrel being moveable between a first and a second position in response to the application of an external force to allow said valve to move between open and closed positions.

Conveniently, the external force to said upper and said lower valves is a hydraulic force applied via conduits running from the well surface to said respective valve housings.

Conveniently, the flapper valves are spring biased, said upper flapper valve being biased to the open position in the absence of a hydraulic force and said lower flapper valve being biased into said closed position in the absence of said hydraulic force.

According to a further aspect of the present invention there is provided a method of running intervention equipment in a wellbore to maximise safety comprising the steps of:

closing a first lower well test valve, lowering an intervention tool through a surface test tree, closing an upper well test valve, said upper well test valve being disposed above said lower well test valve, pressure testing said upper well test valve in a closed position and monitoring the effect of the pressure test on pressure gauges, opening said upper well test valve after said pressure test, actuating said lower well test valve to move to a closed position and conducting a pressure test on said lower well test valve and monitoring the pressure test on pressure gauges, opening said lower well test valve after said pressure test, lowering said intervention tool through said upper and said lower test valves, after running said tool, withdrawing said tool above said lower and said upper valves, actuating said lower test valve to close to isolate the valves from the well and, with said lower valve in the closed position, pulling the intervention tool out of said landing string through said surface tree.

Preferably, said upper valve is actuated between an open and a closed position using hydraulic pressure from said surface. Preferably also, said lower valve is actuated between an open and closed position using hydraulic pressure from said surface.

These and other aspects of the invention will become apparent from the following description when taken in combination with the accompanying drawings in which.

Figure 1:
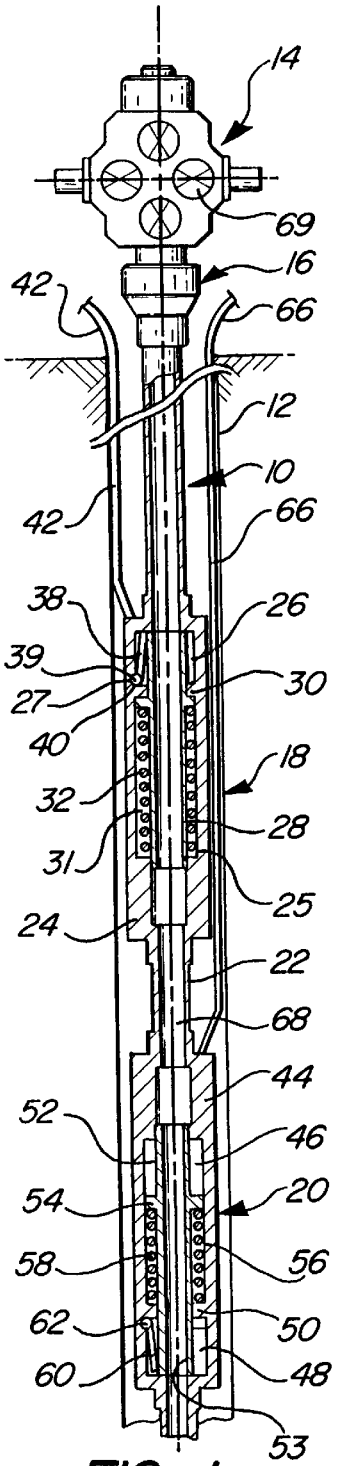
FIG. 1 is a diagrammatic sectional view through the upper part of a wellbore and landing string of a completion lubricator valve in accordance with a preferred embodiment of the present invention, with both the valves shown open to allow normal operation through the well.

Reference is first made to FIG. 1 of the drawings which depicts a landing string generally indicated by reference numeral 10 disposed in a wellbore 12 with the landing string being coupled to a surface test tree 14 via a swivel 16.

The completion lubricator valve consists of an upper fail open test valve (FOTV) generally indicated by reference numeral 18 and a lower subsea safety valve (SSSV) generally indicated by reference numeral 20. The valves are coupled via part of the landing string generally indicated by reference numeral 22.

For ease of description the upper fail open test valve will be described first and then the lower subsea test valve.

The fail open test valve consists of a cylindrical housing 24 separated into two chambers 25,26 by an annular flange 27 within the housing. A moveable cylindrical mandrel 28 is disposed in the housing 24 and the mandrel 28 which carries an annular flange 30 and between the mandrel 28 and the housing 24 an annular cavity 31 is defined in which is disposed a coil spring 32. The upper part of the housing 24 defines the chamber 26 in which is disposed flapper valve plate 38. The valve plate 38 is mounted on a pivot 39 and is biased by a coil spring 40 to the closed position.

In the position shown in FIG. 1 the plate 38 is disposed between the housing and the mandrel 28. The mandrel 28 is, as will be later described, moveable from the position shown downwardly through the housing 24 against the force of coil spring 32. A valve control line 42 is coupled from the surface to the housing 24 and when pressure is applied through the control line 42 to the housing, it forces the mandrel 28 down against the spring force allowing the coil spring 40 to force the FOTV plate 38 to pivot to abut the flange 27 and close the string bore, as will be later described in detail. In the position shown there is no pressure applied via the control line so that the force of the coil spring 32 urges the mandrel 28 upwards within the housing 24 to maintain the flapper valve 38 open in the position shown in FIG. 1.

Figure 2:
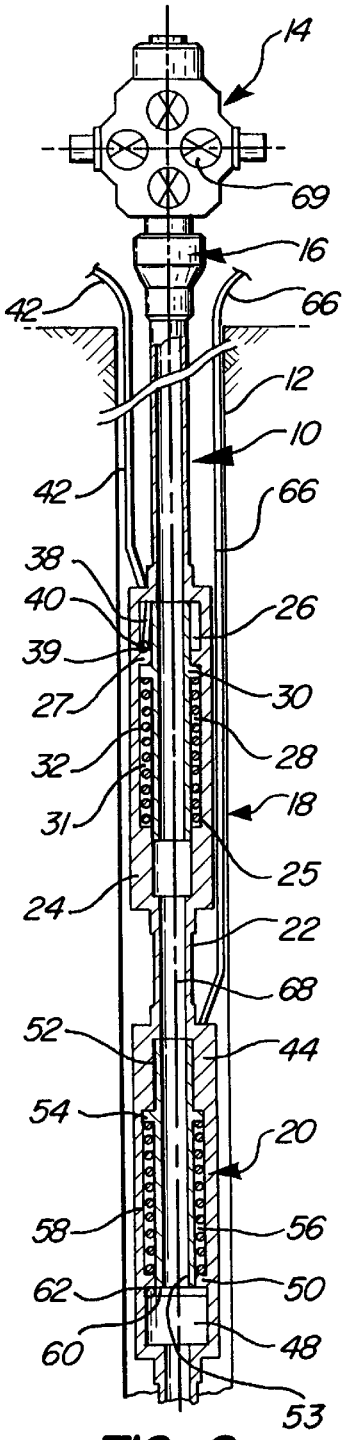
FIG. 2 is a view similar to FIG. 1 but with the lower SSSV valve closed so that a leak-off test can be performed on the lower SSSV valve.
Figure 3:
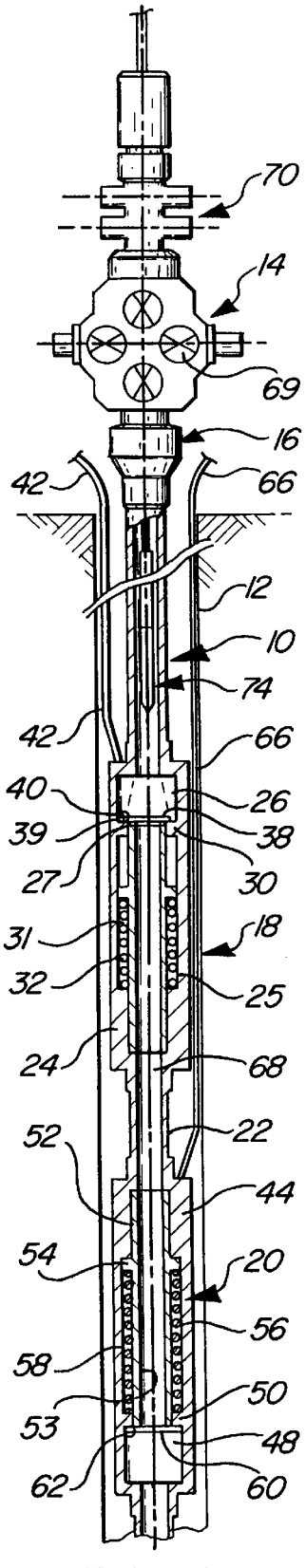
FIG. 3 is a view similar to FIGS. 1 and 2 but depicts a surface BOP connected to the surface test tree for installing the tool string and it also depicts the FOTV and SSSV valves closed.

The subsea safety valve 20 also has a housing 44 which defines a similar internal cavity which is split into two parts 46 and 48 by means of an annular flange 50 which projects inwardly to the bore of the landing string. A moveable mandrel 52 is disposed within the housing 44 and the cylindrical surface 53 of the mandrel forms a continuation of the bore of the landing string. The mandrel is substantially identical to that in the FOTV 18 and has an annular flange 54. The wall of the mandrel 52 and the wall of the housing also define an annular cavity 56 into which is disposed a coil spring 58. The cavity 48 contains a flapper valve 60 plate mounted on a pivot 61. In the position shown in FIG. 1 the flapper valve plate is located in a space between the wall of the housing and the wall of the mandrel 53. The valve plate is biased by coil spring 62 such that if the mandrel is moved up, the spring pivots the valve plate into a closed position as shown in FIGS. 2 and 3.

A subsea valve control line 66 is coupled from the surface to the valve and in the condition shown in FIG. 1 which is normal operation, i.e. no intervention, the SSSV is open. This is because if pressure is applied to the valve via the control line and this urges the mandrel flange 54 down against the force of coil spring 58 which causes the flapper valve plate 60 to remain in the position shown in FIG. 1.

Thus, in normal conditions, i.e. when no intervention work is required, both the valves 18 and 20 are open.

When intervention work is required, the first action necessary is to test the integrity of the valves. This is achieved using the arrangement shown in FIG. 2. In this case, the SSSV open line 66 is bled to remove the pressure therein and in this case the force of the coil spring 58 pushes up the mandrel 53 up allowing the flapper valve 60 to be closed by means of the coil spring 62. With the SSSV closed, a pressure test can be carried out across the SSSV from below to above the valve by bleeding off the interior of the landing string bore 68. The pressure test is monitored by means of valves 69 in the surface test tree. This establishes whether the valve plate 60 is holding the well pressure and if the gauges on the surface test tree indicate that the valve is holding pressure, the operators then go to the next step which is making sure it is safe to enter the well.

Reference is now made to FIG. 3 of the drawings which depicts the procedure for installing tools in the landing string. Prior to installing the tool in the landing string, the surface running equipment for example a BOP stack 70 is coupled to the top of the surface test tree 16. The FOTV 18 is then pressurised by applying pressure to the open line 42 which forces the mandrel 28 down against the coil spring 32 allowing the spring 40 to shut the flapper valve 38 as best seen in FIG. 3. This allows a pressure test from above to be performed to find out whether the FOTV 18 will hold pressure applied from above and, again, the pressure test is monitored using gauges in the surface test tree 70.

The next stage in the procedure is to run in the wireline intervention tool 74 through the surface test tree 16 and above the FOTV 18. After the pressure test is conducted against the FOTV, the results will indicate whether it is safe to re-open the valve. If the results are positive, then the valve is re-opened to allow the tool to be run in to the well. This is achieved by bleeding the FOTV test pressure which allows the coil spring 32 to force the mandrel 28 up against the flapper valve to the position shown in FIG. 1. Then the SSSV control line 66 is pressurised to force the mandrel 53 downwards against the coil spring 58 to open the flapper valve 3. In this condition which is similar to that shown in FIG. 1 both the FOTV and SSV 3 are open and, consequently, intervention equipment can be run through these valves into the well.

In order to retrieve equipment, the equipment 74 is firstly pulled above the flapper valve plate 60 and the SSSV is bled open to allow the valve to shut as shown in FIGS. 2 and 3. Next, the equipment is pulled above the FOTV 18 and pressure applied to the FOTV 18 via line 42 to close the valve plate 38.

Thus, it will be appreciated that the foregoing arrangement offers significant advantage over the prior art arrangements in that a substantial amount of intervention equipment above the surface test tree is avoided.

It will be appreciated that various modifications may be made to the apparatus hereinbefore described without departing from the scope of the invention. For example, the flapper valves may be replaced by apertured ball valves, such as disclosed in applicant's co-pending application PCT/GB92/01351. The valves may be replaced by any other suitable valve types which allow passage of intervention tools and which are movable between an open and a closed position, such that the lower valve allows isolation of the landing string from the well in the closed position and the upper valve allows pressure tests to be conducted from above. It will also be appreciated that these valves, although described as being hydraulically actuated, could be actuated by electrical or pneumatic means.

In addition to the significant cost and safety benefits obtained during the rig up phase, the valve allows longer tool strings to be utilised, therefore reducing the number of runs required to perform an intervention program and providing further cost savings.

A further application of the system is during long term production tests or EPFs conducted from a floating vessel. Because of the location of a subsea test tree within the BOP stack it is not possible to perform a pressure test on the stack. Therefore, to stay within Regulatory Authority Guidelines it is necessary to test the primary safety device, i.e. the subsea test tree. Conventionally, this is done by installing a wireline set plug below the tree and performing a leak-off test. In addition to the non-productive time incurred, the use of plugs can be problematical in this application. The installation of the FOTV below the tree allows this operation to be conducted within a minimum of downtime or reservoir interference. A further advantage is that it also provides the ability to pressure test the landing string after re-latching the tree before opening the tree valves and exposing the landing string to the reservoir pressure.

I claim:

1. A completion lubricator valve for use with horizontal well completions, said completion lubricator valve comprising:

an upper test flapper valve arranged to stay open in the event of valve failure, said upper test valve means having first means for moving said valve between an open position and a closed position, said first valve being urged into an open position in the absence of external force applied to said upper test valve means, a lower test flapper valve spaced from said upper test valve means and arranged to close the bore of the completion lubricator valve in the event of failure of said lower test valve means, said lower test valve means having second means for moving said valve between an open and a closed position, said second valve means being urged into a closed position in the absence of an external force applied to said lower test valve means, the arrangement being such that when an external force is applied to said upper test valve means said valve is moved to a closed position and a pressure test can be performed against said closed valve from above, and in the absence of an external force being applied to said lower tool valve means the valve is closed and a leak-off test can be performed against said lower test valve means from below.

2. A valve as claimed in claim 1 wherein the external force to said upper and said lower flapper valves is a hydraulic force applied via conduits running from the well surface to said respective valve housings.

3. A valve as claimed in claim 1 wherein the upper and lower flapper test valves are spring biased flapper valves, said upper flapper test valve being biased to the open position in the absence of a hydraulic force and said lower flapper test valve being biased into said closed position in the absence of a said hydraulic force.

4. A method of running intervention equipment in a wellbore to maximise safety comprising the steps of:

closing a lower well flapper test valve, lowering an intervention tool through a surface test tree, closing an upper well flapper test valve, said upper well flapper test valve being disposed above said lower well test flapper valve, pressure testing said upper well flapper test valve in a closed position and monitoring the effect of the pressure test on pressure gauges, opening said upper well flapper test valve after said pressure test, actuating said lower well flapper test valve to move to a closed position and conducting a pressure test on said lower well flapper test valve and monitoring the pressure test on pressure gauges, opening said lower well flapper test valve after said pressure test, lowering said intervention tool through said upper and said lower flapper test valves, after running said tool, withdrawing said tool above said lower and said upper flapper test valves, actuating said lower flapper test valve to close to isolate the valves from the well and, with said lower flapper test valve in the closed position, pulling the intervention tool out of said landing string through said surface tree.

5. A method as claimed in claim 4, wherein said upper flapper test valve is actuated between an open and a closed position using hydraulic pressure from said surface.

6. A method as claimed in claim 4, wherein said lower flapper test valve is actuated between an open and closed position using hydraulic pressure from said surface.

* * * * *